US010660449B2

(12) United States Patent
Scarleski

(10) Patent No.: US 10,660,449 B2
(45) Date of Patent: May 26, 2020

(54) ADJUSTABLE MATTRESS RETAINER BARS

(71) Applicant: LEVITATION SCIENCES LLC, Chicago, IL (US)

(72) Inventor: William John Scarleski, Chicago, IL (US)

(73) Assignee: Levitation Sciences LLC, Chicago, IL (US)

( * ) Notice: Subject to any disclaimer, the term of this patent is extended or adjusted under 35 U.S.C. 154(b) by 0 days.

(21) Appl. No.: 15/596,184

(22) Filed: May 16, 2017

(65) Prior Publication Data

US 2018/0064262 A1 Mar. 8, 2018

Related U.S. Application Data

(63) Continuation of application No. 14/304,385, filed on Jun. 13, 2014, now Pat. No. 9,668,588.

(51) Int. Cl.
*A47C 21/00* (2006.01)
*A47C 21/02* (2006.01)

(52) U.S. Cl.
CPC ..... *A47C 21/026* (2013.01); *A47C 21/00* (2013.01)

(58) Field of Classification Search
CPC ..... A47C 21/00
USPC ..... 5/658, 659, 411, 193, 503.1
See application file for complete search history.

(56) References Cited

U.S. PATENT DOCUMENTS 4,839,932 A * 6/1989 Williamson ..... A47C 20/048 5/615
6,240,583 B1 * 6/2001 Brooke ..... A61G 7/012 5/430
7,805,789 B1 * 10/2010 Dean ..... A61G 7/053 5/646
8,776,294 B1 * 7/2014 McCarty ..... A47C 21/026 5/193
2014/0250594 A1 * 9/2014 Rawls-Meehan ..... A61G 7/015 5/400
2014/0304914 A1 * 10/2014 Schnake ..... A61G 7/05 5/600

* cited by examiner

*Primary Examiner* — Fredrick C Conley
(74) *Attorney, Agent, or Firm* — K&L Gates LLP

(57) ABSTRACT

A mattress retention assembly is disclosed that includes a mattress retainer system for retaining a mattress in place that is supported by an adjustable platform assembly and more particularly to a mattress retainer system that includes mattress retainer bars. The mattress retainer system is attached to the adjustable platform assembly. In order to secure the mattress relative to the adjustable platform assembly, one or more mattress retainer bars for the head and foot of the bed along with the corners of the bed are provided. In accordance with an important aspect of the invention, the mattress retainer bars are movable or removable to allow the mattress retainer bars to be positioned flush or below the top surface of the adjustable platform assembly to enable easy and convenient rotation, maneuverability, or otherwise sliding of the mattress relative to the platform. After the mattress is rotated, maneuvered, or slid, the mattress retainer is re-positioned to restrain movement of the mattress with respect to the adjustable platform assembly.

17 Claims, 13 Drawing Sheets

ADJUSTABLE MATTRESS RETAINER BARS

CROSS REFERENCE TO RELATED APPLICATIONS

This application is a continuation of U.S. application Ser. No. 14/304,385, filed Jun. 13, 2014, now U.S. Pat. No. 9,668,588, hereby incorporated by reference.

BACKGROUND OF THE INVENTION

1. Field of the Invention

The present invention relates to mattress retainer bars for retaining a mattress in place that is supported by an adjustable platform assembly and more particularly to mattress retainer bars that are attached to the adjustable platform assembly and can be adjusted to enable the mattress to be rotated or slid off of the mattress to install, launder, or change a bed skirt or protective mattress encasement.

2. Description of the Prior Art

Conventional beds with adjustable platform assemblies are known for home use. An example of such a bed is disclosed in U.S. Pat. No. 7,810,194, hereby incorporated by reference. Such beds normally include a motorized adjustable platform assembly and a mattress. Some known adjustable platform assemblies cause the mattress to be contorted into various configurations. Some of those configurations would cause the mattress to move or slide out of position relative to the adjustable platform assembly.

Such movement is highly undesirable. In order to prevent such movement, various methods have been developed to prevent movement of the mattress as a result of the various configurations of the adjustable platform assembly. In order to prevent such movement, various mattress retainer systems have been developed. Examples of such mattress retainer systems are disclosed in the following US: U.S. Pat. Nos. 6,684,425 and 7,810,194. Mattress retainer systems are also disclosed in the following US published applications: US 2010/0229309 A1 and US 2013/0185868 A1.

These mattress retainer systems fall into various categories. For example, some known mattress retainer systems are generally disposed at the head and/or foot end of the bed. Examples of this type of mattress retainer system are disclosed in U.S. Pat. Nos. 6,684,425; 7,353,550; and US Patent Application Publication No. US 2010/0229309 A1. Other known mattress retainer systems are used to restrain the of the mattress on the foot end of the bed. An example of this type of retainer system is disclosed in US Patent Application Publication No. US 2013/0185868 A1. Finally, other types of mattress retainer systems utilize fasteners to secure a mattress having a rigid substrate to an adjustable platform assembly. An example of this mattress retainer system is disclosed in U.S. Pat. No. 7,810,194.

Known mattress retainer systems can also be categorized by how they are disposed relative to the mattress and the platform. Several known systems rely on friction to retain the mattress retainer system in place.

One such system that relies on friction is disclosed in the '425 patent mentioned above. That system includes a mattress retainer bar disposed at the foot end of the bed that extends upwardly from the adjustable platform assembly to prevent the mattress from sliding toward the foot end of the bed during various configurations of the adjustable platform assembly. In order to further "secure" the mattress retainer bar is formed with a tongue, perpendicularly disposed relative to the plane of the mattress retainer bar. The extending tongue is disposed between the mattress and the adjustable platform assembly and is designed to provide increased friction between the mattress and the bar and the adjustable platform assembly and the bar than the friction of the mattress and the adjustable platform assembly without the tongue therebetween.

US Patent Application Publication No. US 2010 0229309 A1 is another type of mattress retainer system that relies on friction, as well as clamping forces to hold the mattress retainer system in place between an adjustable platform assembly and a mattress. Specifically, the mattress retainer system includes a mattress retainer bar that is configured to be disposed so as to extend upwardly from adjustable platform assembly to retain the mattress in place. The mattress retainer bar is formed in a "C" shape defining a pair of spaced apart legs connected together at one end by a bight portion. A paper clip type arrangement is formed at the opposing end of the legs in a plane perpendicular to the plane of the mattress retainer bar. The paper clip arrangements are used to clip the mattress retainer bar to the adjustable platform assembly.

Both of the systems described above rely at least partially on friction to "secure" the mattress retainer system relative to the adjustable platform assembly. In particular, the mattress retainer system disclosed in '425 system relies totally on friction to secure the mattress retainer system relative to the bed. The '309 application relies on clamping forces as well as friction to secure the mattress retainer in place relative to the bed.

Such systems that rely on friction have a limited utility. In particular, such systems need to be designed to withstand the weight of the mattress as well as one or two occupants of the bed. In other words, the force of the weight will oppose the friction force.

Mattresses are relatively heavy items. The weight of a mattress varies as a function of the coil core, the gauge of the coil and the type of foam material used. An average king size mattress weighs between 85 and 115 pounds. High end king size mattresses with latex or memory foam can weigh as much as 300 pounds (www.mattressdirectonline.com). With two people on the bed, the force opposing the friction and the clamping forces could therefore be 600 pounds or more. Although the systems described above could likely provide satisfactory performance with older lighter weight mattresses, it would seemingly be impossible to provide a sufficient amount of friction to oppose a weight force with heavier mattresses, as discussed above.

As such, mattress retainer systems have been developed that are permanently secured to the adjustable platform assembly. Examples of such mattress retainer systems are disclosed in U.S. Pat. Nos. 7,353,550 and 7,810,194 as well as US Patent Application Publication No. 2013/0185868 A1. Although these mattress retainer systems solve the problem described above, such mattress retainer systems cause another problem.

In particular, a problem with the various types of mattresses is that over time, the mattress materials lose their resiliency causing body depressions to develop. In order to even out the wear in the mattress, it is known to rotate the mattress in the horizontal plane to relocate the body depressions. In order to rotate a mattress with a permanently installed mattress retainer system, the mattress retainer system would have to be removed in order to rotate the mattress and re-installed after the mattress was rotated. Alternatively, the mattress could be lifted up high enough to clear the mattress retainer system; rotated and subsequently lowered into place. In order to rotate a mattress, the mattress must first be lifted and then rotated. Both methods are relatively cumbersome. Moreover, rotating a mattress is hard work. Depending on the weight of the mattress, rotating a mattress would be virtually impossible for some people, such as senior citizens, as well as people that are handicapped or disabled and others.

Thus there is a need for a mattress retainer system that can be securely attached to the adjustable platform assembly while facilitating rotation of a mattress.

SUMMARY OF THE INVENTION

Briefly, the invention relates to a mattress retainer system for retaining a mattress in place that is supported by an adjustable platform assembly and more particularly to a mattress retainer system that includes at least one mattress retainer bar. The mattress retainer system is attached to the adjustable platform assembly. In order to secure the mattress relative to the adjustable platform assembly, one or more mattress retainer bars for the head and foot of the bed along with the of the bed are provided. In accordance with an important aspect of the invention, the mattress retainer bars are movable and removable to allow the mattress retainer bars to be positioned under the top surface of the adjustable platform assembly to enable easy and convenient rotation of the mattress. After the mattress is rotated, the mattress retainer system is re-positioned to restrain movement of the mattress with respect to the adjustable platform assembly.

DESCRIPTION OF THE DRAWING

These and other advantages of the present invention will be readily understood with reference to the following specification and attached drawing wherein.

DETAILED DESCRIPTION

The invention relates to mattress retainer system for retaining a mattress in place that is supported by an adjustable platform assembly and more particularly to a mattress retainer system that includes mattress retainer bars. The mattress retainer system is attached to the adjustable platform assembly. In order to secure the mattress relative to the adjustable platform assembly, one or more mattress retainer bars for the head and foot of the bed along with the corners of the bed are provided. Both the head and foot retainer bars, as well as the corner can be configured to be removable or movable to a position below the top surface of the platform to allow the mattress to rotated or otherwise slid off of, onto, or about the platform. In accordance with an important aspect of the invention, the mattress retainer bars are movable to allow the mattress retainer bars to be positioned under the top surface of the adjustable platform assembly to enable easy and convenient rotation of the mattress. After the mattress is rotated, the mattress retainer is re-positioned to restrain movement of the mattress with respect to the adjustable platform assembly.

Figure 1:
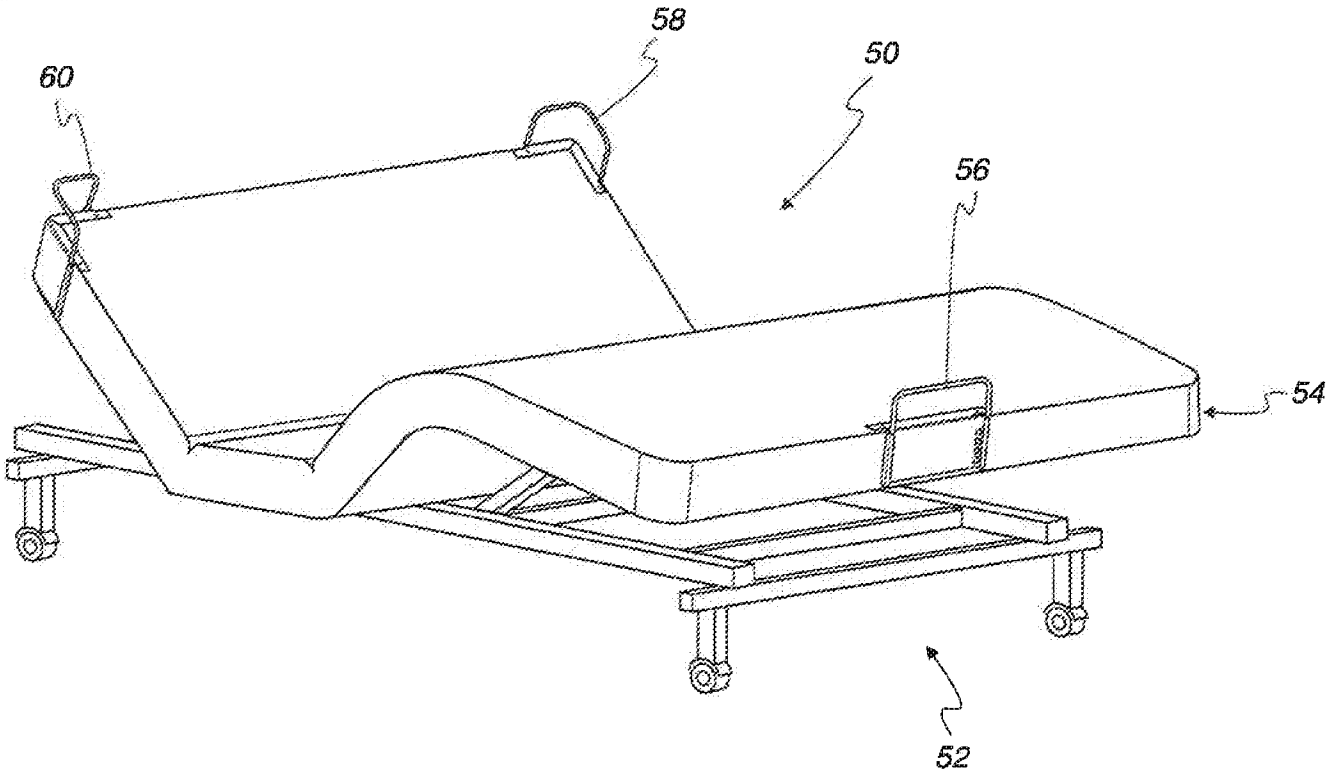
FIG. 1 is an isometric view of a known adjustable platform assembly, shown in a contorted position illustrating the mattress retainer bars in accordance with the present invention attached to the on one end and to a foot end on the opposing end.

Referring to FIG. 1, a conventional adjustable platform assembly for supporting a mattress is shown in a contorted position and identified with the reference numeral 50. An example of such an adjustable platform assembly is disclosed in detail in US Patent Application Publication No. 2008/0000027 A1, hereby incorporated by reference. Such adjustable platform assemblies 50 are motorized and enable a user to select various contorted positions, normally by way of a remote control device (not shown). Known adjustable platform assemblies include a carriage assembly, generally identified with the reference numeral 52, and an upper support 54. The upper support 54 is normally formed from a stiff material, such as upholstered wood, metal, or particle board, or other similar materials, and is formed in sections, some of which are pivotally mounted with respect to the carriage assembly 52 in order to allow the contortions of the mattress into various user selected positions.

As shown in FIG. 1, a mattress retainer bar 56 in accordance with the invention is attached to one end of the adjustable platform assembly 50. A pair of mattress retainers 58 and 60 in accordance with an alternative aspect of the invention is secured to the corners of the upper support 54 of the adjustable platform assembly 50 on an opposing end.

Other configurations of the mattress retainer bars 56, 58 and 60 with respect to their placement relative to the adjustable platform assembly 50 are possible. For example, the mattress retainer bars 58 and 60 on the corners of the upper support 54 of the adjustable platform assembly 50 at the head end can be omitted. Alternatively, the mattress retainer bar 56 at the foot end of the adjustable platform assembly 50 can be omitted and replaced with mattress retainer bars 58 and 60 on the corners of the upper support 54 adjustable platform assembly 50 at the foot end. Alternatively, any number of retainer bars can be used at the head, foot, and corners of the adjustable platform assembly to hold the mattress in place. All such configurations are intended to be within the broad scope of the invention.

Figure 18:
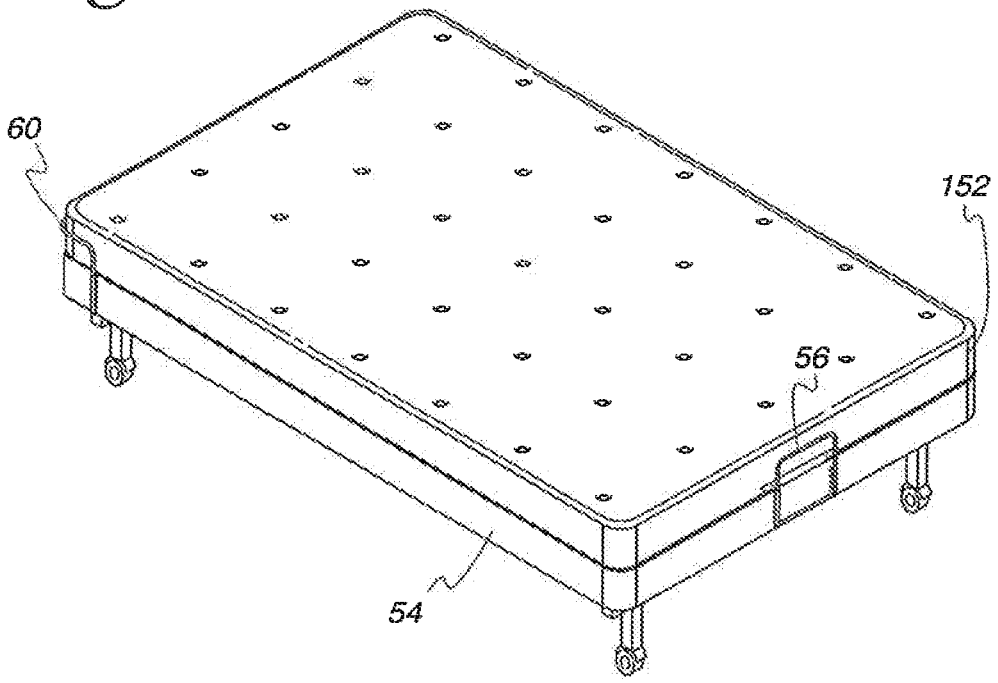
FIG. 18 is similar to FIG. 17 but shown with a mattress on top of the adjustable platform assembly.
Figure 19:
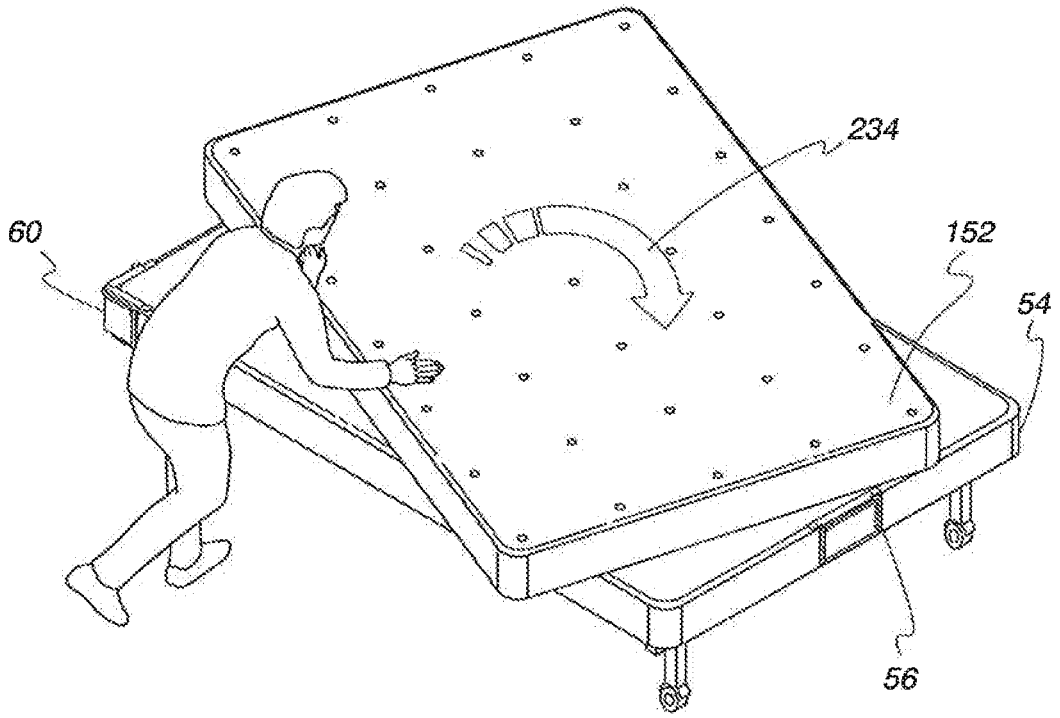
FIG. 19 is similar to FIG. 18 but shown with the various mattress retainer bars all in a retracted position, illustrating rotation of a mattress.

As will be discussed in more detail below, the mattress retainer bars in accordance with the present invention include a mounting bracket that is secured to one end or a corner of the upper support 54 of the adjustable platform assembly 50; a mattress retainer bar; and a detent mechanism, used to latch the mattress retainer bar in a fully extended position, as illustrated in FIG. 18, or alternatively allow the mattress retainer bar to be placed in a retracted position, as illustrated in FIG. 19 to allow the mattress to be rotated with respect to the upper support 54 of the adjustable platform assembly 50.

Two types of mattress retainer assemblies in accordance with the invention are contemplated. One type is designed to be typically secured to the head or foot end of the upper support 54 of the adjustable platform assembly 50. An exemplary version of this type of mattress retainer bracket is identified with the reference numeral 56 (FIG. 1) and is also referred to as an "end" mattress retainer assembly. The end mattress retainer assembly can be used on the head and foot ends of the upper support 54 of the adjustable platform assembly 50. The end mattress retainer assembly can also be used on the sides of the upper support of the adjustable platform assembly 50. The second type of mattress retainer assembly is designed to be attached to one or more of the corners of the upper support 54 of the adjustable platform assembly 50 and is also referred to as a "corner" mattress retainer assembly. An exemplary version of this type of mattress retainer is illustrated in FIG. 1 and identified with the reference numerals 58 and 60.

FIGS. 2-7 illustrate an exemplary embodiment of an end type of mattress retainer assembly. FIGS. 13-16 illustrate an exemplary alternate embodiment of an end type of mattress retainer assembly. FIGS. 8-12 illustrate an exemplary embodiment of a corner type mattress retainer assembly.

The embodiments described and illustrated herein are merely exemplary. Other variations of end and corner mattress retainer assemblies are contemplated. The mattress retainer assembly in accordance with the present invention need only be either moveable or removable and have an extended position in which the mattress retainer bar is configured to retain the position of the mattress relative to the adjustable platform assembly 50 and a retracted position in which the mattress retainer bar can selectively be placed below the top surface of the adjustable platform assembly in order to maneuver the mattress relative to the platform; and an optional detent mechanism for securing the mattress retainer bar in an extended position. All such embodiments which meet the above criteria are considered to be within the broad scope of the invention.

Figure 2:
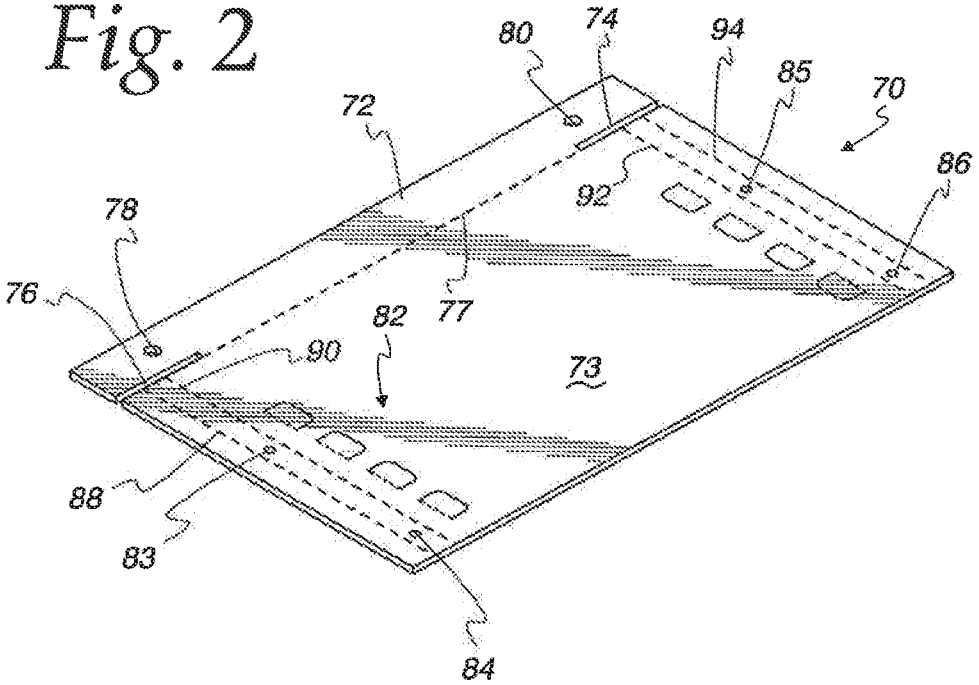
FIG. 2 is an isometric view of an un-formed bracket for use with the invention.
Figure 3:
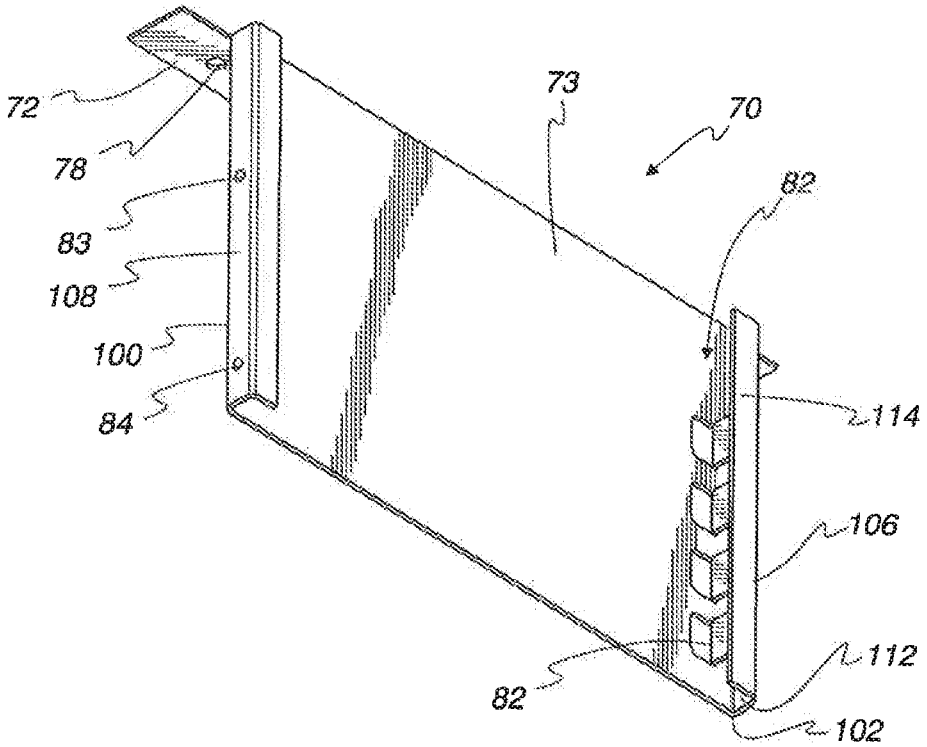
FIG. 3 an isometric view of the bracket illustrated in FIG. 2, shown after it has been formed into a bracket for use with mattress retainer bars for the head and foot ends of the bed.

As mentioned above, the mattress retainer assembly in accordance with the present invention includes a bracket, a mattress retainer bar and a detent mechanism. An exemplary embodiment for one such bracket for an end type mattress retainer assembly is illustrated in FIGS. 2 and 3. As shown in FIG. 2, the bracket, general identified with the reference numeral 70, can be stamped from a blank consisting of a flat piece of rigid material. As shown the blank includes a top flange portion 72 that is designed to be secured to a top surface of the upper support 54 of the adjustable platform assembly 50 and a bracket portion 73. The flange portion 72 is formed by providing opposing aligned slits 74 and 76 on opposing ends of the blank and spaced from the top of the blank to define the width of the flange portion 72. The blank may be under scored between the opposing slits 74 and 76, as indicated by the dashed line 77, to facilitate bending of the flange portion 72 so that it is generally perpendicular to the plane of the bracket portion 73. A pair of mounting holes 78 and 80 is provided in the flange portion 72 to enable the bracket 70 to be secured to a top surface of the upper support 54 of the adjustable platform assembly 50 with suitable conventional fasteners. A number of aligned spaced apart tabs, generally identified with the reference numeral 82, are formed adjacent opposing ends of the bracket. As shown, four tabs are shown on each end. As shown in FIGS. 3, 4, 6 and 7, the tabs 82 are bent upwardly to a position generally perpendicular to the bracket portion 73. Through holes 83, 84 and 85, 86 are formed adjacent opposing ends of the bracket portion 73. In this exemplary embodiment the through holes 83, 84 and 85, 86 form part of the detent mechanism. As will be discussed in more detail below, the through holes 83 and 85 are define an extended position while the holes 84 and 86 may be used to define a retracted position or eliminated altogether.

Each end of the bracket portion 73 is under scored with a pair of parallel spaced apart scores 88, 90 and 92, 94. These under scores are used to facilitate bends along the ends of the bracket portion 73. Specifically, the bends 90 and 92 facilitate the bends 100 and 102 while the under scores 88 and 94 facilitate the bends 104 and 106. The bends 100 and 104 form a sidewall portion 108 and a top wall portion 110 on one end of the bracket portion 73. Similarly, the bends 102 and 106 form a sidewall portion 112 and a top wall portion 114.

A portion of the bracket portion 73, the side wall 108, the top wall 110 as well as the tabs 82, bent up toward the top wall 110 form a cavity for receiving and providing a track for one leg of a mattress retainer bar. Similarly, a portion of the bracket portion 73 on an opposing end, the side wall 112, the top wall 114 as well as the tabs 82, bend up toward the top wall 114 to form a cavity for receiving and providing a track for the other leg of a mattress retainer bar.

Figure 4:
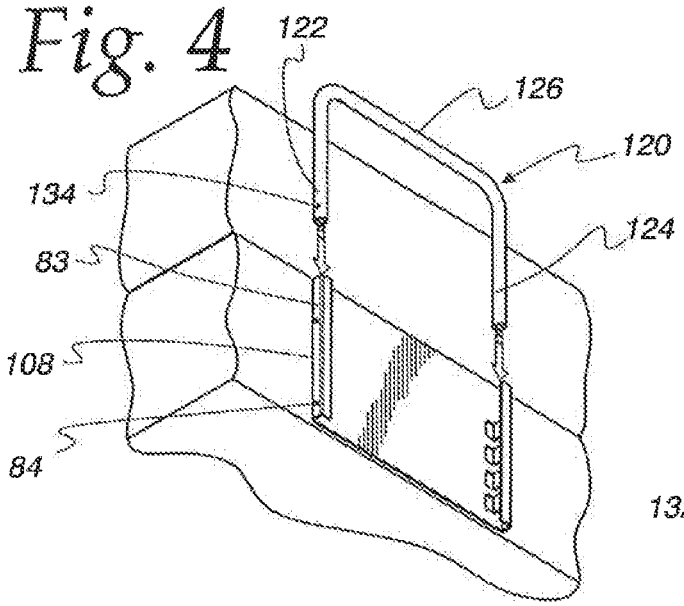
FIG. 4 is an isometric illustrating a section of the adjustable platform assembly and mattress with the bracket illustrated in FIG. 3 attached to one end of the adjustable platform assembly, shown with a mattress retainer bar removed.

The mattress retainer bar for an end mattress retainer assembly is best illustrated in FIG. 4 and generally identified with the reference numeral 120. The mattress retainer bar includes a pair of spaced apart legs 122 and 124 connected together by a bight portion 126. As shown in FIG. 4, the opposing legs are received in the cavities formed in the bracket as discussed above.

Figure 5:
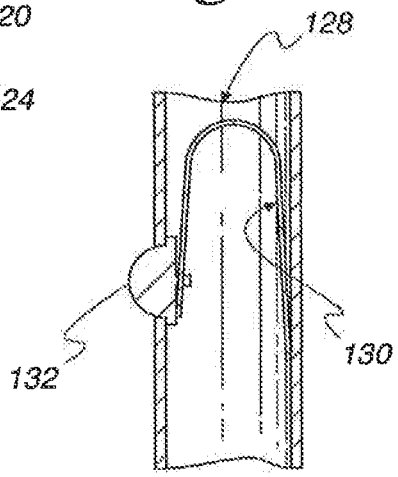
FIG. 5 is a partial vertical section view of a portion of the mattress retainer bar, shown with a button pin arrangement in a detent position.

As illustrated in FIG. 5, the mattress retainer bar 120 is formed from a hollow tube and includes a detent mechanism consisting of a spring loaded button, generally identified with the reference numeral 128 which is formed from a spring 130 and a button 132. Each of the legs 122 and 124 are formed with a through hole. These through holes 134 are for receiving the spring loaded button 132, as illustrated in FIG. 5.

As mentioned above, each of the legs 122 and 124 is received in the cavities formed on the opposing ends of the bracket 70. The mattress retainer bar 120 is inserted into the cavities until the button 132 on each leg 122, 124 is received in the top most holes 83 and 85 (FIGS. 2 and 4) formed in the side walls 108 and 112. The cavities are sized such that as the respective legs 122 and 124 are inserted into the cavities, the respective buttons 132 on each of the legs 122, 124 is pushed inwardly against the force of the spring 130. As the buttons 132 become aligned with the holes 83 and 85 (FIG. 2) in the cavities, the buttons 132 are pushed out under the force of the springs 130 and are received in the holes 83 and 85 to define a first detent position or extended position, as illustrated in FIG. 6.

Figure 6:
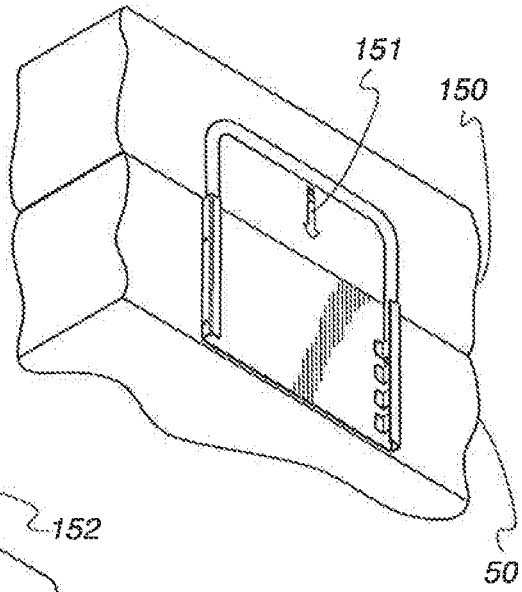
FIG. 6 is an isometric view of a portion of the adjustable platform assembly and mattress, shown with the bracket illustrated in FIG. 3 attached to the adjustable platform assembly and the mattress retainer bar partially installed in the bracket.

As shown in FIG. 6, a mattress 150 is supported on top of a support surface of an adjustable platform assembly 50. A bracket 70 is mounted to the support surface 54 of the spring retainer assembly 50. With the mattress retainer bar 120 in an extended position, as shown, the mattress 150 is constrained from moving in the direction by the arrow 152, as shown in FIG. 7.

Figure 7:
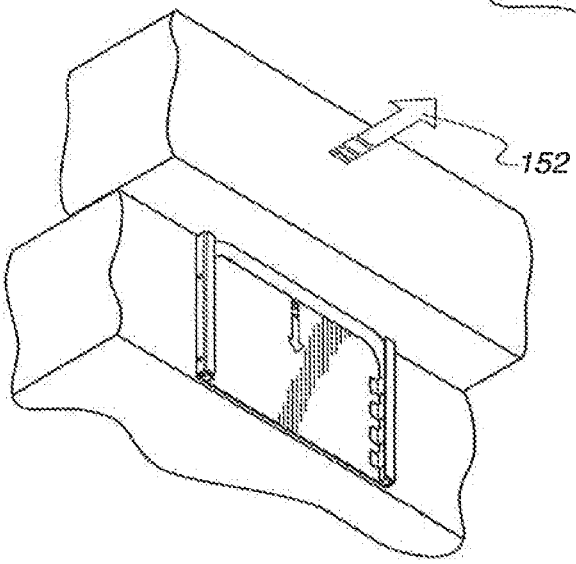
FIG. 7 is similar to FIG. 6 but shown with the mattress retainer bar in a fully retracted position and the mattress partially slid off the adjustable platform assembly.

In order to place the spring retainer bar in a retracted position, as shown in FIG. 7, the buttons 132 on the legs 122 and 124 of the mattress retainer bar 120 are pushed inwardly against the force of the springs 130. The spring retainer bar 120 is moved further downwardly in the direction of the arrow 151 until the buttons 132 pop into the holes 84 and 86 (FIG. 2) in the bracket 70, which defines a second detent position or a retracted position, as shown in FIG. 7. In a retracted position, as shown in FIG. 7, the mattress retainer bar is below the top surface of the upper support 54 of the adjustable platform assembly 50 to allow the mattress to move in the direction of the arrow 152, past the plane of the mattress retainer bar 120 to enable the mattress to slide or be rotated.

The holes 84 and 86 in the bracket 70 can optionally be omitted. In this embodiment, downward travel of the mattress retainer bar will be limited by the bight portion 126 of the mattress retainer bar 120 striking the top tabs 82 on the bracket 70.

FIGS. 8-12 relate to corner mattress retainer assemblies. The construction of the bracket 160 for the corner mattress retainer 58, 60 (FIG. 1). The bracket 160 for the corner mattress retainer assembly 58, 60 is similar to the bracket 70 for the end mattress retainer assembly 56. For brevity, only the differences will be discussed. All of the rest of the manufacturing details are the same.

Figure 8:
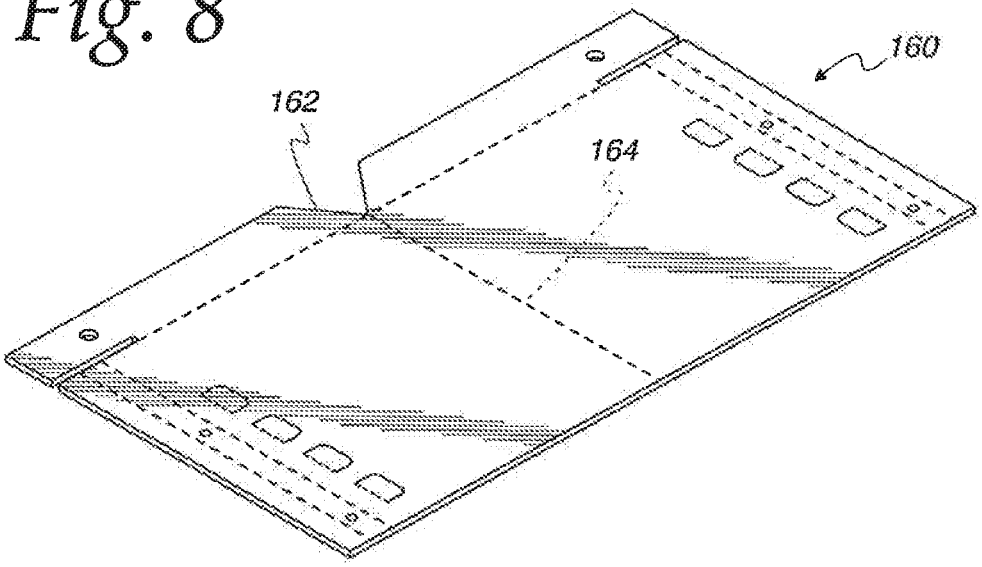
FIG. 8 is similar to FIG. 2 but for a corner mattress retainer bar.
Figure 9:
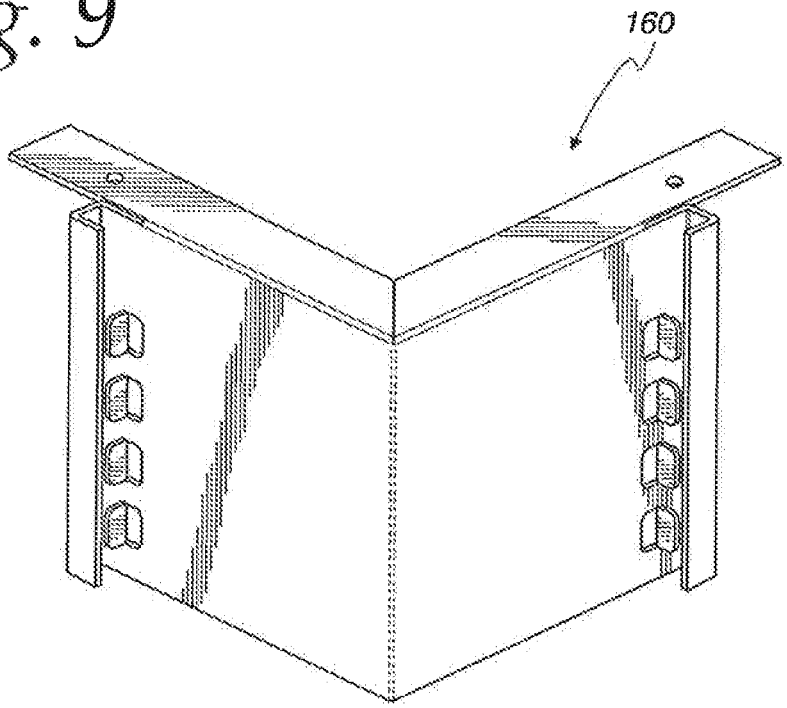
FIG. 9 an isometric view of the bracket illustrated in FIG. 8, shown after it has been formed into a bracket for use with mattress retainer bars for the mattress.
Figure 10:
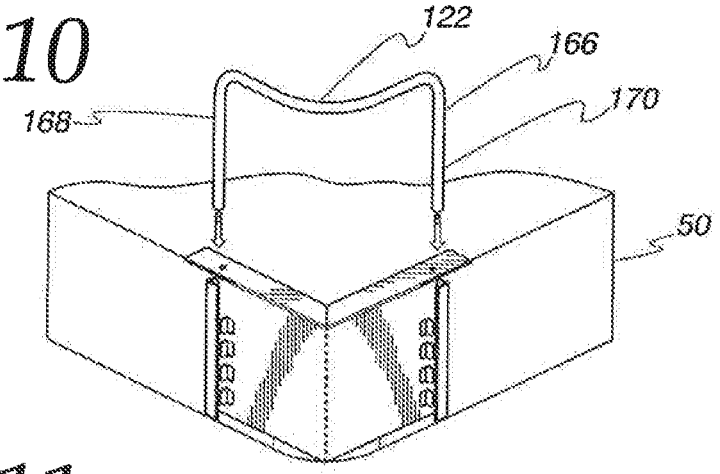
FIG. 10 is an isometric illustrating a section of the adjustable platform assembly and mattress with the bracket illustrated in FIG. 9 attached to one corner of the adjustable platform assembly, shown with a mattress retainer bar removed.

Referring first to FIG. 8 a "V" 162 is cut out of the center of the top edge of the bracket 160. In addition, the center of the bracket 160 is under scored, as indicated by the dotted line 164. These additional details allow the bracket 160 to be bent along the under score 164 forming two halves that are mutually perpendicular to each other, as shown in FIG. 9.

The mattress retainer bar 166 (FIG. 10) for the corner mattress retainer assembly 58, 60 (FIG. 1) and includes a pair of spaced apart parallel legs 166 and 168 connected together by a bight portion 172. The bight portion 172 is bent and follows the radius of curvature of the rounded mattress corner 174.

Figure 11:
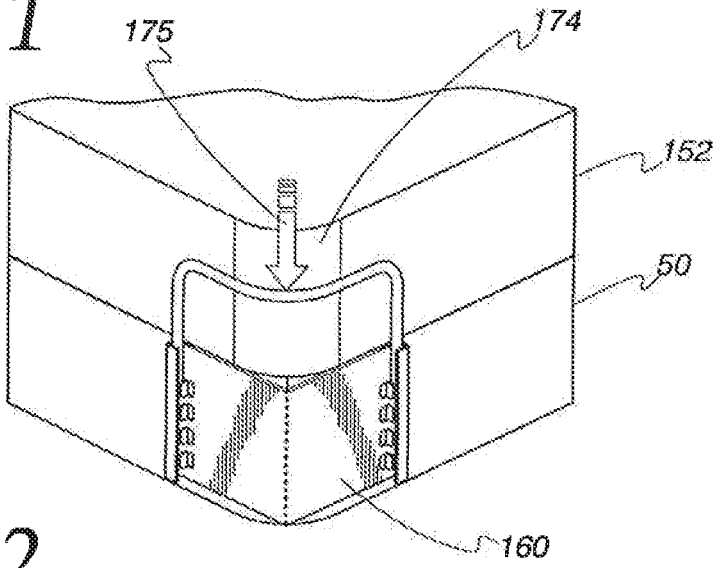
FIG. 11 is an isometric view of a portion of the adjustable platform assembly and mattress, shown with the bracket illustrated in FIG. 10 attached to one corner of the adjustable platform assembly and the mattress retainer bar partially installed in the bracket.

The mattress retainer bar 166 is formed from a hollow tube and includes a detent mechanism, as discussed above. As shown in FIG. 11, the mattress retaining bar 166 is received in the cavities formed in the bracket 160 and moved downwardly in the direction of the arrow 175 until the detent mechanism, such as the detent mechanism discussed above, reaches the extended detent position. In this position the mattress is restrained from moving beyond intersecting planes of the bracket 160.

Figure 12:
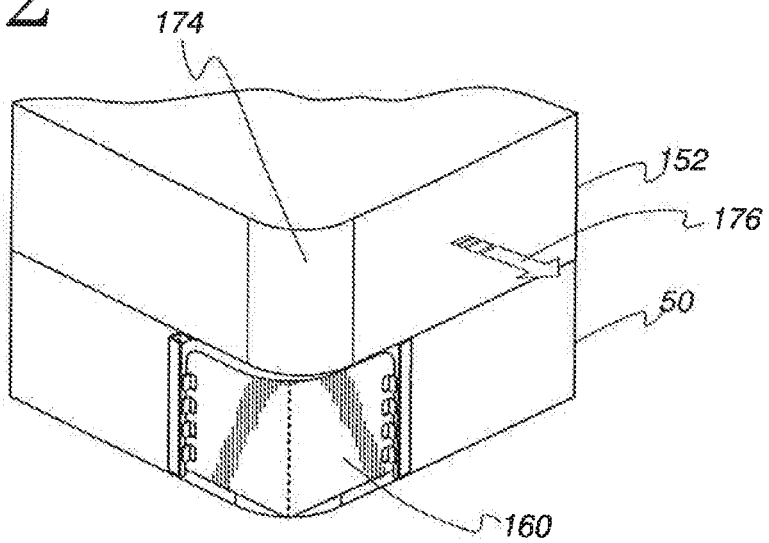
FIG. 12 is similar to FIG. 11 but shown with the mattress retainer bar in a fully retracted position and the mattress partially slid off the adjustable platform assembly.
Figure 13:
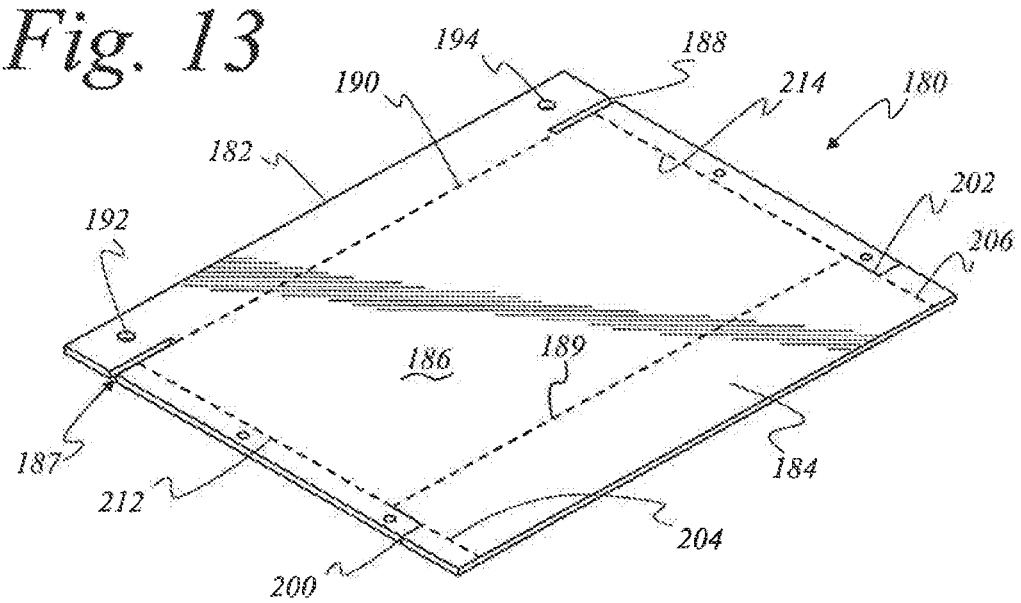
FIG. 13 is an isometric view of an un-formed bracket for use with an alternate embodiment of the invention.
Figure 14:
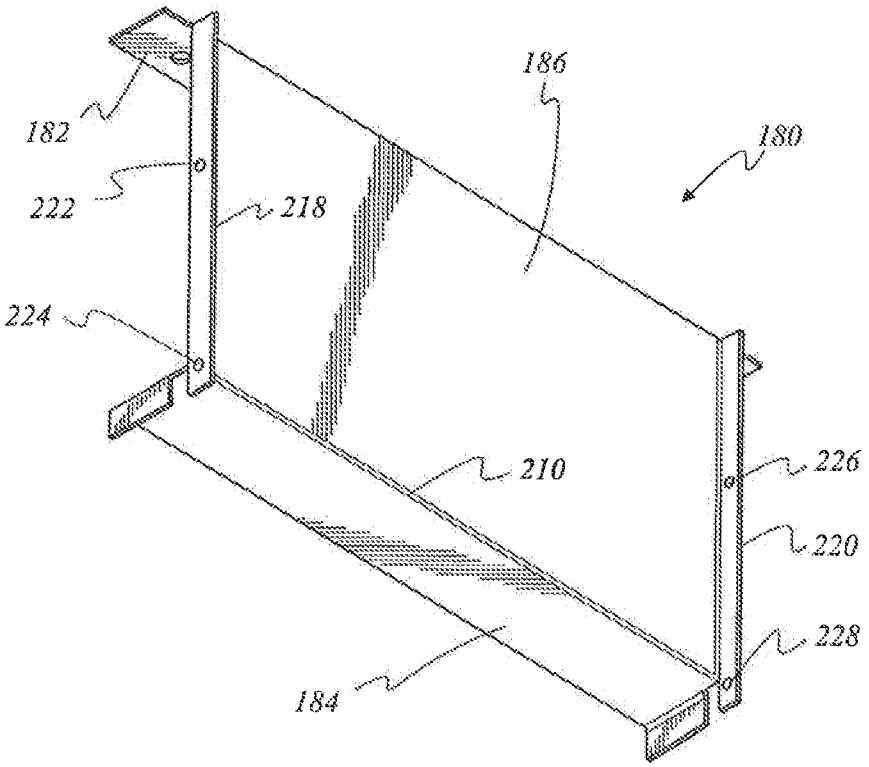
FIG. 14 an isometric view of the bracket illustrated in FIG. 13, shown after it has been formed into a bracket for use with an alternate embodiment of the invention for use as a mattress retainer bar for the head and foot ends of the bed.

In order to move the mattress in the direction of the arrow 176, the mattress retainer bar is moved to the retracted position, as shown in FIG. 12. In this position, the mattress retainer bar is below the bottom surface of the mattress 152 in order to allow the mattress 152 to slide in the direction of the arrow 176 or be rotated.

Figure 15:
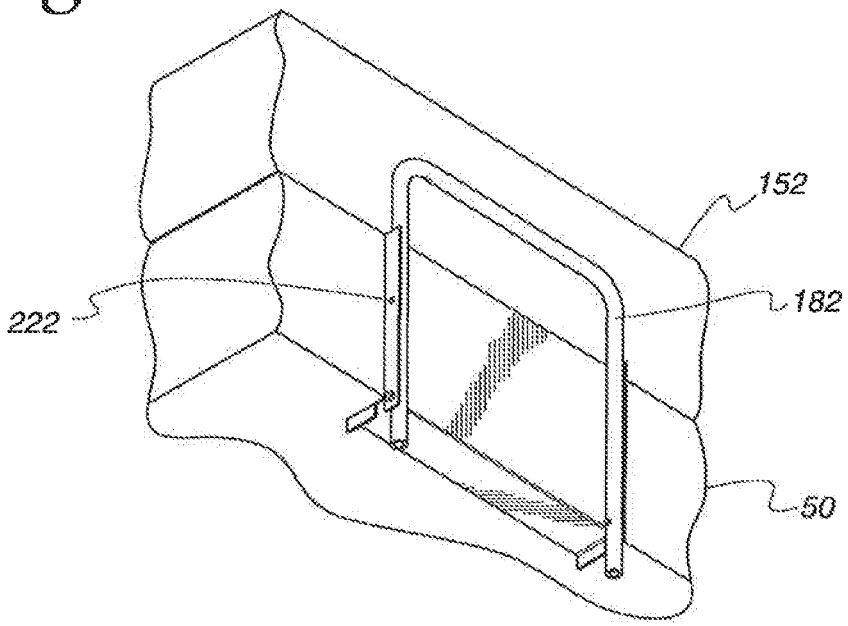
FIG. 15 is an isometric view of a portion of the adjustable platform assembly and mattress, shown with the bracket illustrated in FIG. 14 attached to one end of the adjustable platform assembly and further shown with the mattress retainer bar in an extended position.

FIGS. 13-16 illustrate an alternative embodiment of an end mattress retainer assembly. This embodiment also includes a bracket 180. This embodiment includes a pivotally mounted mattress retainer bar 182 (FIG. 15). The bracket 180 can be stamped from a blank consisting of a flat piece of rigid material. As shown the bracket 180 includes a top flange portion 182 that is designed to be secured to a top surface of the upper support 54 of the adjustable platform assembly 50. The bracket 180 also includes a bottom flange portion 184 and a bracket portion 186. The top flange portion 182 is formed by providing opposing aligned slits 187 and 188 on opposing ends of the blank and spaced from the top of the blank to define the width of the top flange portion 182. The blank may be under scored between the opposing slits 187 and 188, as indicated by the dashed line 190, to facilitate bending of the top flange portion 182 so that it is generally perpendicular to the plane of the bracket portion 186. A pair of mounting holes 192 and 194 is provided in the top flange portion 182 to enable the bracket 180 to be secured to a top surface of the upper support 54 of the adjustable platform assembly 50 with suitable conventional fasteners.

Figure 16:
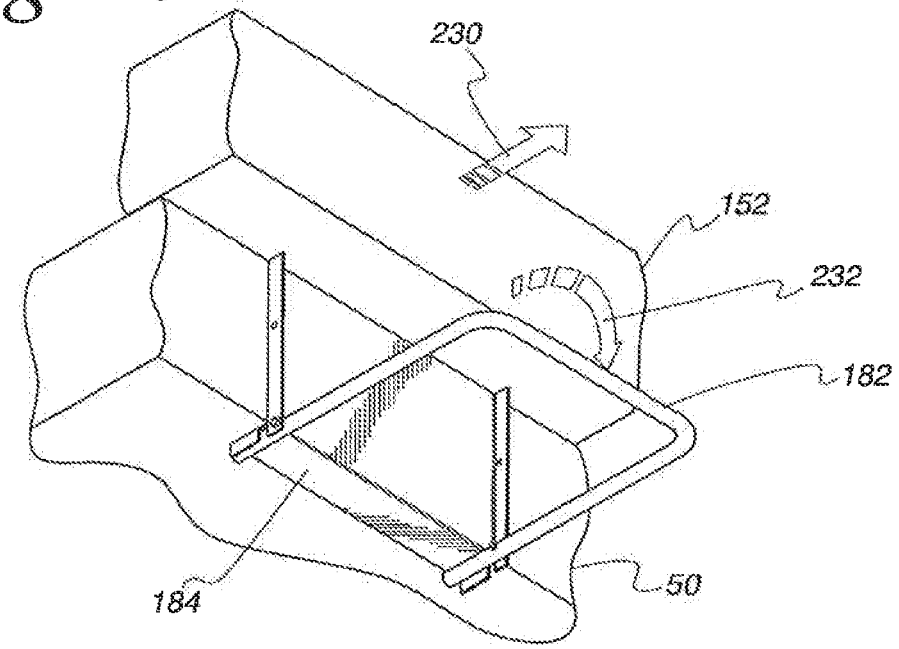
FIG. 16 is similar to FIG. 15 but shown with the mattress retainer bar in a fully retracted position and the mattress partially slid off the adjustable platform assembly.

The bottom flange portion 184 is disposed on the underside of the upper support surface 54, as generally shown in FIGS. 15 and 16. In order to form the lower flange portion 184, an under score is provided, as indicated by the dashed line 189. Two slits 200 and 202 are provided adjacent opposing edges of the bracket 180 along with two perpendicular under scores 204 and 206. As shown best in FIG. 14, such a configuration allows the lower flange port 184 to be bent along the line 210.

A pair of under scores 212 and 214 adjacent opposing edges of the bracket 180. These under scores allow the edges to be bent in a generally perpendicular direction from the bracket portion 186 defining a pair of spaced apart side walls Each of the side walls 218 and 220 includes a pair of through holes 222, 224 and 226, 228. The holes 224 and 228 form a pivot axis. The though holes 222 and 226 form part of the detent mechanism, as will be discussed in more detail below.

Turning to FIGS. 15 and 16, the mattress retainer bar 182 is similar to the mattress retainer bars discussed above with the exception that it is pivotally mounted relative to the sidewalls 218 and 220. The configuration of the bottom flange portion 184 allows the pivot axis to extend below the bottom surface of the upper support 54.

FIG. 15 illustrates an extended position. Spring loaded buttons (not shown) in the mattress retainer bar 182 are received in the holes 222 (FIG. 14) and 226 in the side walls 218 and 220, respectively to secure the mattress retainer bar 182 in the extended position, as shown in FIG. 15 to prevent movement of the mattress 152 with respect to the upper support 54 of the platform assembly 50.

In order to slide the mattress 152 in the direction of the arrow 230 or rotate the mattress 152, the spring loaded buttons (not shown) are pushed inwardly and the mattress retainer bar 182 is rotated in the direction of the arrow 232 to allow the mattress retainer bar to be rotated to the extended position, as shown in FIG. 16. In this position, the mattress retainer bar 182 is below the top surface of the upper support 54 of the adjustable platform assembly 50 to allow the mattress 152 to be moved in the direction of the arrow 230 and rotated.

Figure 17:
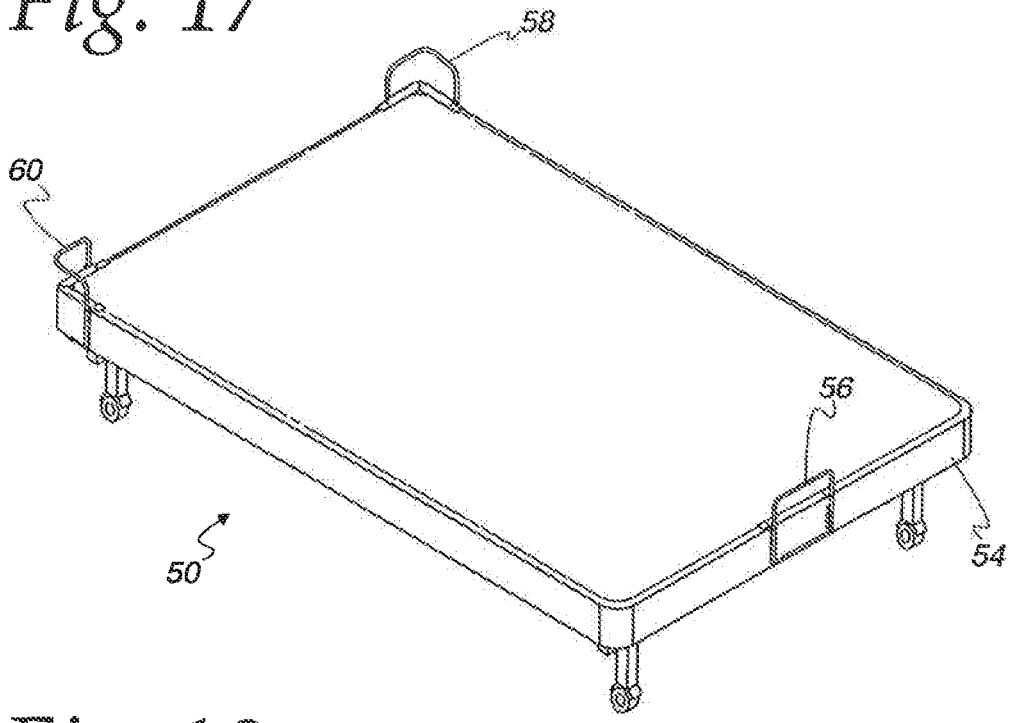
FIG. 17 is an isometric view of an adjustable platform assembly shown with mattress retainer bars in accordance with the present invention installed on two and one end of the adjustable platform assembly, all shown in an extended position.

FIG. 17 illustrates an exemplary application of the invention. In this embodiment, an end mattress retainer assembly 56 is disposed at a foot end of an upper support of an adjustable support assembly 50 and corner mattress retainer assemblies 58 and 60 are disposed on opposing corners at the head end. FIG. 18 illustrates a mattress disposed on top of the upper support 54 of an adjustable support assembly 50 in a flat position. As shown the mattress retainer assemblies 56, 58 and 60 are latched in an extended position. In order to rotate the mattress 152 in the direction of the arrow 234, the head mattress retainer assembly 56, as well as the corner mattress retainer assemblies 58 and 60 are placed in a retracted position, as shown. After the mattress 152 is rotated 180 degrees, the head mattress retainer assembly 56 and the corner mattress retainer assemblies 58 and 60 are returned to an extended position, as shown in FIGS. 17 and 18.

Figure 20:
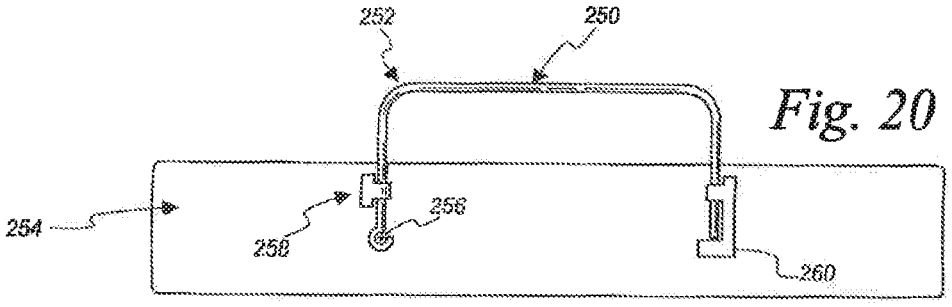
FIG. 20 is an alternate embodiment of the mattress retainer system, illustrating a mattress retainer bar located at one end of the bed that pivots in a plane generally perpendicular to plane of the mattress, shown in a normal position.
Figure 21:
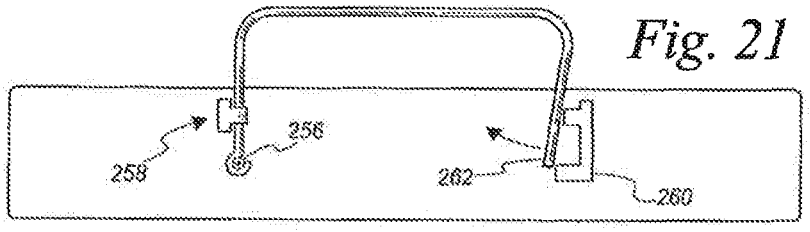
FIG. 21 illustrates the mattress retainer system illustrated in FIG. 20 in an intermediate position.
Figure 22:
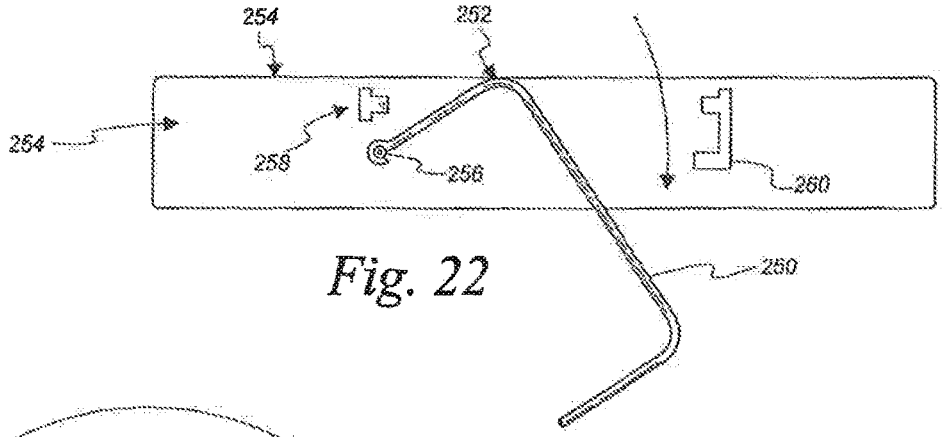
FIG. 22 illustrates the mattress retainer system illustrated in FIG. 20 in an extended position.

FIGS. 20-22 illustrate another alternate embodiment of a mattress retainer system, which includes a U-shaped retainer bar 250 that pivots on one end about a pivot axis. In this embodiment, the retainer bar 250 rotates in a clockwise direction so that a knee 252 on the fixed end of the retainer bar 250 below or flush with a top surface of a platform 254. The pivot axis 256 is secured to the platform 254 along an axis generally parallel to the plane of the platform 254 in a rest position, as shown in FIG. 20.

The mattress retainer bar system illustrated in FIGS. 20-22 includes two retaining brackets 258 and 260. These brackets 258 and 260 hold the retainer bar 250 against the side of the platform 254 in a normal position, as shown in FIG. 20. These brackets 258 and 260 restrain movement of the retainer bar 250 in a direction parallel to the pivot axis 256 in a direction out of the page with respect to FIG. 20. The bracket 258 is located adjacent the pivot axis 256 and also acts as a stop to prevent counter-clockwise rotation beyond a normal position. The bracket 260 is located adjacent a free end of the retainer bar 250. The bracket 260 also acts as a stop and prevents clockwise rotation in a normal position.

With reference to FIG. 21, operation of the mattress retainer system is illustrated. In order to rotate the retainer bar 250, one leg 252 is bent slightly toward the pivot axis 256 to free the retainer bar 250 from the bracket 260. Once the retainer bar 250 is free from the bracket 260, the retainer bar 250 is rotated in a clockwise direction, as shown in FIG. 22 until the knee 252 of the retainer bar 250 is flush or below the plane of the top surface of the platform 254 defining an extended position.

Once the retainer bar 250 is in an extended position as shown in FIG. 22, the mattress (not shown) can be freely rotated with respect to the platform 254. Once the mattress is rotated to its desired position, the retainer bar 250 is rotated counter-clockwise and the leg 262 is latched with respect to the bracket 260 to return the retainer bar 250 to its normal position, as illustrated in FIG. 20. As mentioned above, the bracket 258 serves to stop counter-clockwise rotation of the retainer bar 250 once the retainer bar 250 is in a normal position, as illustrated in FIG. 20. The bracket 260 serves to stop clockwise and counter clockwise rotation of the retainer bar 250 once the retainer bar 250 is in a normal position, as illustrated in FIG. 20. Both brackets 258 and 260 hold the retainer bar 250 against the sides of the foundation or platform to hold the retainer bar 250 in an upright position to hold mattress in position relative to the foundation and keep it from sliding off of the foot of the bed.

Figure 23:
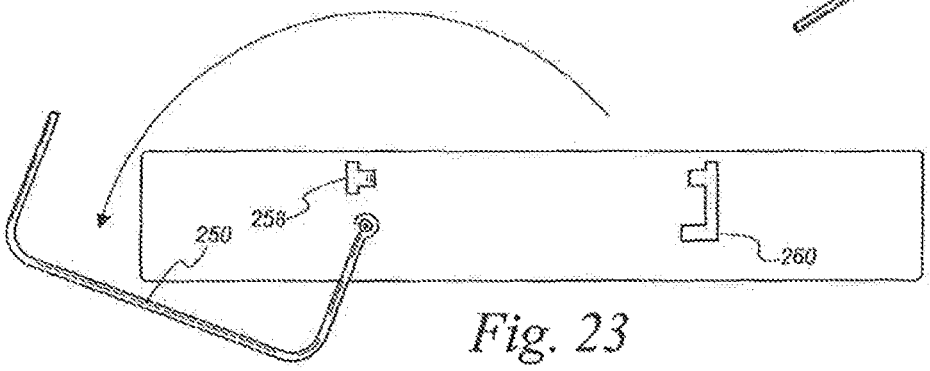
FIG. 23 illustrates an alternate embodiment of the mattress retainer system illustrated in FIG. 20, shown in an extended position.

FIG. 23 is an alternate embodiment of the mattress retainer system illustrated in FIGS. 20-22. In this embodiment, the direction of rotation from a normal position to an extended position is counter-clockwise, as shown. The bracket 260 is the same but the orientation of 258 is flipped as shown to allow counterclockwise rotation of the retainer bar 250.

Figure 24:
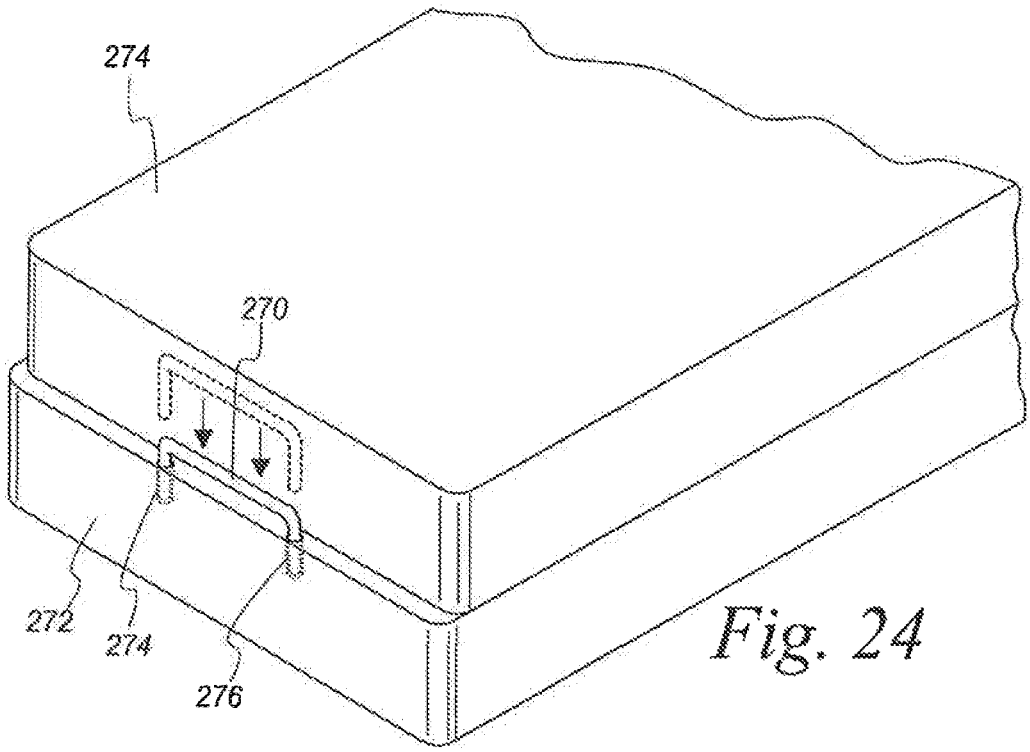
FIG. 24 is an isometric view illustrating an alternate embodiment of the retainer bar system that is movable in a direction generally perpendicular to the plane of the mattress, shown in a retracted position with the normal position shown in phantom.
Figure 25:
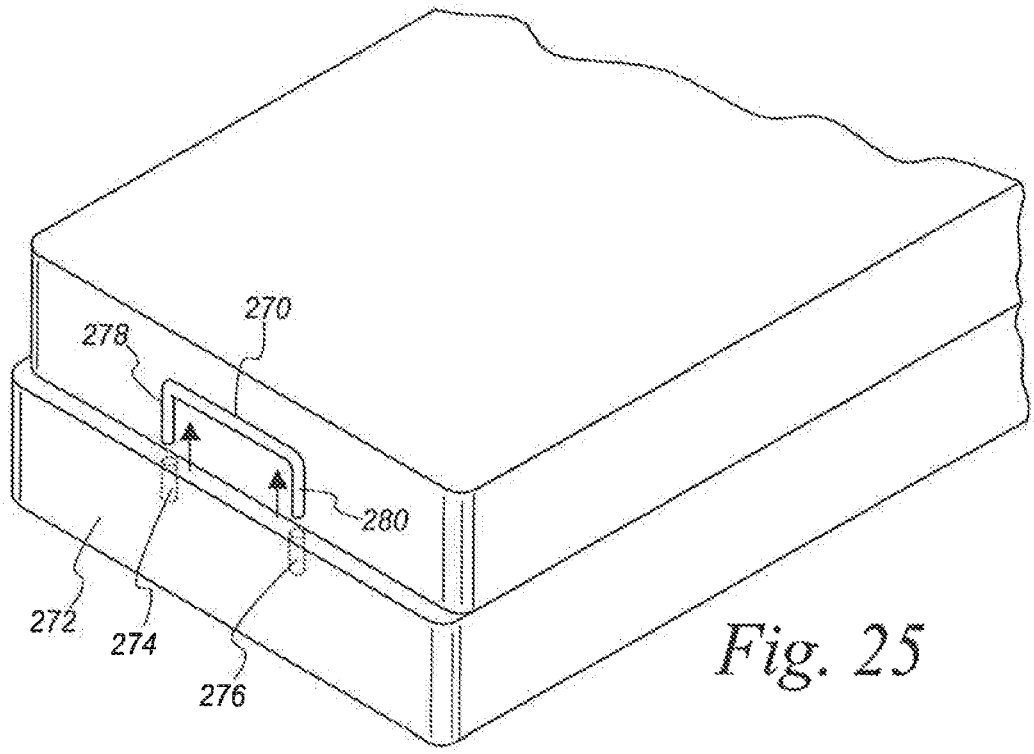
FIG. 25 is similar to FIG. 24 illustrating another alternate embodiment that is that is movable in a direction generally perpendicular to the plane of the mattress and removable, shown with the retainer bar removed.

FIGS. 24 and 25 illustrate additional alternate embodiments in which a C-shaped retainer bar 270 is movably attached to one end of a foundation 272. In both embodiments, the retainer bar 270 is movable in a direction that is generally perpendicular to the plane of the platform 272. In particular, wells 274 and 276 are formed in the platform 272, as shown, and configured to receive the legs 278, 280 of the retainer bar 272. Alternatively, the wells can be formed by tube shaped brackets attached to the side of the platform or foundation to receive the ends of the retainer bar 270. In the embodiment shown in FIG. 24, the retainer bar 274 is pushed downwardly to a retracted position to enable a mattress 274 to be rotated with respect to the platform 272. In the embodiment illustrated in FIG. 25, the retainer bar 270 is removable.

Figure 26:
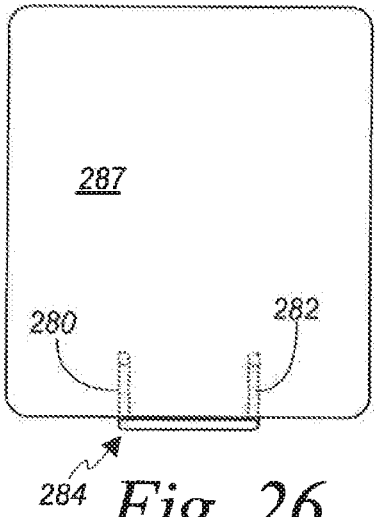
FIG. 26 is a top view of a mattress illustrating another alternate embodiment of the invention in which the retainer bar is movable in a direction parallel to the plane of the mattress.
Figure 27:
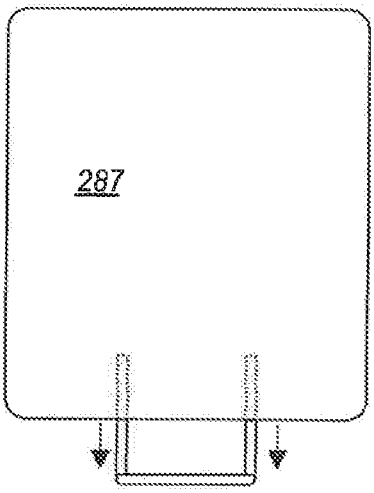
FIG. 27 is similar to FIG. 26 but shown in an extended position.
Figure 28:
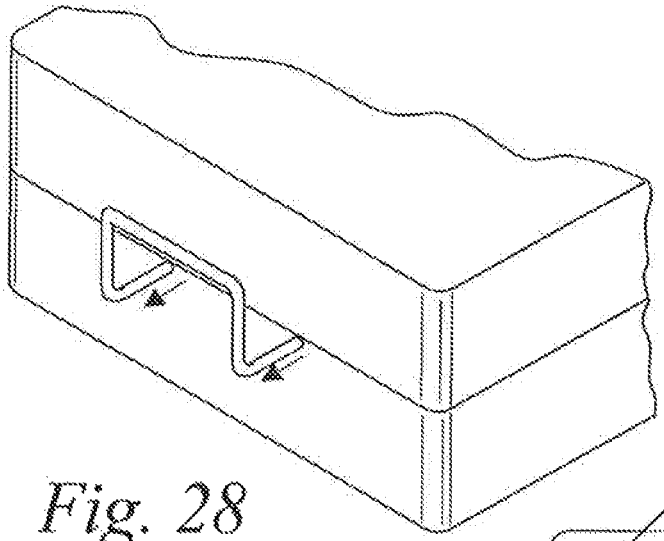
FIG. 28 is a partial isometric view of the embodiment illustrated in FIGS. 26 and 27, shown with the retainer bar in an extended position.

FIGS. 26-28 are similar to FIGS. 24 and 25 except the wells 280 and 282 for receiving the retainer bar 284 are formed in the platform 286 (FIG. 29) in a direction parallel to the plane of the platform 286. Alternatively, the wells can be formed by tube shaped brackets attached to the top of the platform or foundation to receive the ends of the retainer bar 270. In this embodiment, the retainer bar 284 is movable in a direction generally parallel to the direction of the plane of the platform 286. FIG. 26 illustrates a normal position while FIGS. 27-29 illustrate extended positions.

Figure 29:
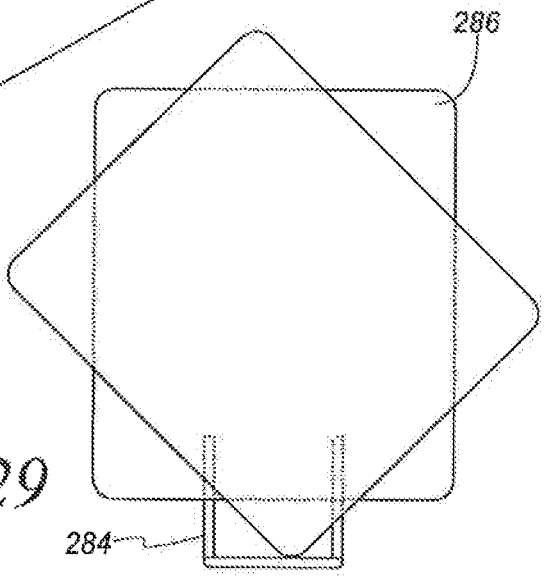
FIG. 29 is a top plan view of a mattress and foundation and the retainer system illustrated in FIGS. 26-28 shown with a mattress partially rotated with respect to the foundation.

Once the retainer bar 284 is extended, the mattress 287 can be rotated as shown in FIG. 29.

Obviously, many modifications and variations of the invention are possible in light of the above teachings. Thus, it is to be understood that, within the scope of the appended claims, the invention may be practiced otherwise than as specifically described above.

I claim:

1. A mattress retainer assembly designed to be attached to an upper support of an adjustable platform assembly, the mattress retainer assembly comprising:

one or more brackets, each bracket formed to be securely attached to a corner of an upper support of an adjustable platform assembly; and one or more mattress retainer bars, each mattress retainer bar movably mounted relative to said bracket, said one or more mattress retainer bars movable between an extended vertical position and a retracted vertical position, wherein:

when said one or more mattress retainer bars is in the extended vertical position, movement of a mattress relative to said upper support is constrained; and when said one or more mattress retainer bars is in the retracted vertical position, movement of the mattress is not constrained.

2. The mattress retainer assembly as recited in claim 1, wherein at least one of said brackets and one of said retainer bars are formed for rectilinear movement.

3. The mattress retainer assembly as recited in claim 2, wherein said rectilinear movement is in a direction generally perpendicular to a top surface of said adjustable platform assembly.

4. The mattress retainer assembly as recited in claim 1, wherein at least one of said brackets and one said retainer bars are formed so that said retainer bar can be removed from said bracket.

5. The mattress retainer assembly as recited in claim 1, wherein at least one of said brackets is formed in V shape to enable said bracket to be secured to adjacent sides of a corner of said upper support of said adjustable platform by way of fasteners.

6. The mattress retainer assembly as recited in claim 1, wherein said mattress retainer bar is formed in a generally C shape with two spaced apart legs connected together by a bight portion.

7. The mattress retainer assembly as recited in claim 1, further including a detent mechanism for latching said mattress retainer bar in said extended vertical position.

8. The mattress retainer assembly as recited in claim 7, wherein said detent mechanism includes a spring-loaded button that received in a through hole in one of the spaced apart legs that cooperates with a through hole in said bracket in said normal position.

9. A mattress retainer assembly designed to be attached to an upper support of an adjustable platform assembly, the mattress retainer assembly comprising:

a bracket formed to be securely attached to an upper support of an adjustable platform assembly; and a mattress retainer bar movably mounted relative to said bracket, said mattress retainer bar movable linearly between an extended vertical position in which movement of a mattress relative to the top surface of said upper support of said adjustable platform is constrained and a retracted vertical position in which movement of the mattress is not constrained.

10. A mattress retainer assembly as recited in claim 9, wherein said mattress retainer bar is movable in a direction generally perpendicular to a top surface of said upper support.

11. A mattress retainer assembly as recited in claim 9, wherein said bracket and said mattress retainer bar are formed so that said mattress retainer bar is removable from said bracket.

12. The mattress retainer assembly as recited in claim 9, wherein said mattress retainer bar is formed in a generally C shape with two spaced apart legs connected together by a bight portion.

13. A mattress retainer assembly as recited in claim 12, further including a detent mechanism for latching said mattress retainer bar in said extended vertical position.

14. The mattress retainer assembly as recited in claim 13, wherein said detent mechanism includes a spring-loaded button that received in a through hole in one of the spaced apart legs that cooperates with a through hole in said bracket in said extended vertical position.

15. A method for rotating a mattress relative to the top surface of an adjustable platform having one or more retainer bars received in one or more wells formed in an upper support of said adjustable platform for selectively constraining rotational movement of said mattress, the method comprising the steps:

(a) positioning said one or more retainer bars to enable rotation of said mattress;

(b) rotating said mattress on the top surface of said adjustable platform;

(c) returning said one or more retainer bars to a constrained position.

16. The method as recited in claim 15, wherein step (a) includes removing said one or more retainer bars from said one or more wells.

17. A method for rotating a mattress relative to the top surface of an adjustable platform having one or more retainer bars carried by a bracket attached to an upper support of said adjustable platform, said one or more retainer bars initially in a constrained position for selectively constraining rotational movement of said mattress, the method comprising:

positioning said one or more retainer bars to allow rotation of said mattress;

rotating said mattress on the top surface of said adjustable platform;

returning said retainer bars to a constrained position, thereby preventing further rotation of said mattress.

* * * * *